United States Patent [19]

Murakami

[11] 4,064,960

[45] Dec. 27, 1977

[54] NOISE BARRIER

[75] Inventor: Norio Murakami, Kawasaki, Japan

[73] Assignee: Showa Koji K.K., Kawasaki, Japan

[21] Appl. No.: 679,713

[22] Filed: Apr. 23, 1976

[30] Foreign Application Priority Data

| | | |
|---|---|---|
| Aug. 27, 1975 | Japan | 50-102887 |
| Dec. 23, 1975 | Japan | 50-152848 |
| Dec. 27, 1975 | Japan | 51-176324 |
| Jan. 12, 1976 | Japan | 51-2148 |

[51] Int. Cl.[2] ..... G10K 11/00

[52] U.S. Cl. ..... 181/210; 181/290

[58] Field of Search ..... 181/33 G, 33 HE

[56] References Cited

U.S. PATENT DOCUMENTS

| | | | |
|---|---|---|---|
| 2,052,984 | 9/1936 | Madison | 181/33 G |
| 2,177,393 | 10/1939 | Parkinson | 181/33 G |
| 2,841,255 | 7/1958 | Kemp | 181/33 G |
| 3,095,943 | 7/1963 | Kemp | 181/33 G |
| 3,656,576 | 4/1972 | Gubela | 181/33 HE |
| 3,804,196 | 4/1974 | Horn et al. | 181/33 G |

FOREIGN PATENT DOCUMENTS

| | | | |
|---|---|---|---|
| 872,519 | 7/1961 | United Kingdom | 181/33 G |

*Primary Examiner*—Lawrence R. Franklin
*Attorney, Agent, or Firm*—Oblon, Fisher, Spivak, McClelland & Maier

[57] ABSTRACT

Disclosed is a noise barrier which comprises a hollow-cell type block having as its principal components a perforated sound-absorbing plate opposed to the noise source and a sound-insulating plate disposed opposite said sound-absorbing plate and incorporating therebetween a sound-absorbing material, a free spacing plate disposed behind said block across an intervening free air layer and means for absorbing and damping sound energy (a vibration-repressing coupling). There is also disclosed a noise barrier having a plurality of adjacent hollow-cell type blocks provided jointly with a free spacing plate by the medium of a support column so as to cover the supporting face.

13 Claims, 13 Drawing Figures

NOISE BARRIER

BACKGROUND OF THE INVENTION

This invention relates to a noise barrier which combines high transmission loss and high sound-absorbing coefficient with excellent vibration proofing effect and which is directed to preventing noises and secondary noises issuing from wheeled vehicles travelling at high rates of speed and from machines productive of high solid sounds (sound waves generated from the surface of solid because of contact of two or more solid articles).

In recent years, high solid sounds generated by solid articles because of operations such as of cutting, deformation, friction and impact performed thereon and traffic noises generated by speeding vehicles on super highways and railroads have been degrading the life environment, posing a serious social problem. With a view to coping with this problem, there has been felt a strong need to develop a noise barrier capable of internally absorbing generated sounds and insulating sound waves and consequently preventing them from being propagated externally as well as measures for decreasing the absolute number of noise sources and means for lessening sounds in intensity. The sounds thus generated are propagated in conjunction with the vibrations which are generated by speeding vehicles and machines productive of solid sounds and the noises which are secondarily radiated because of said vibrations. Thus, the mere act of increasing the mass of the noise barrier or adding to the height of the noise barrier only results in an increase in the area of radiation of said secondary noises and cannot be expected to bring about the true effect of a noise barrier.

The present inventor formerly invented a noise barrier which has an extremely high transmission loss as compared with the conventional noise barrier and which comprises 1 a hollow cell type block composed of a hollow cell-shaped box and a sound-absorbing material filling said box, said hollow cell-shaped box consisting of a perforated sound-absorbing plate on the side confronting the source of sound and a sound-insulating plate opposed to said sound-absorbing plate and 2 a free-spacing plate disposed opposite said sound-insulating plate across a space parallel to said sound-insulating plate and connected with said plate by the medium of an elastic member so as to interpose a free air layer between said free-spacing plate and said sound-insulating plate.

Although the noise barrier of said construction has an extremely high transmission loss and is effective as a barrier to acoustic energy, it still suffers from a defect also common to conventional sound barriers in that it is not sufficiently effective as a barrier to vibratory energy.

The inventor continued a further study with a view to improving the basic structure of the noise barrier of said former invention. We have consequently acquired a knowledge that besides the sound energy in the ordinary sense of the word, the sound-producing energies which impinge upon the noise barrier can be divided into three types. The present invention has been accomplished on the basis of this knowledge. To be specific, the sound-producing energies fall under the following three types:

1. The acoustic energy which propagates in the air and penetrates through the noise barrier and, in the case of a noise barrier incorporating joints, also penetrates through said joints.
2. The vibratory energy which propagates in the air to reach the noise barrier and produces vibration in the noise barrier.
3. The vibratory energy which travels along the ground surface or through the elevated structure supporting the noise barrier and produces vibration in the noise barrier or its stationary auxiliary parts such as supporting columns.

The vibratory energy indicated in 2 and that indicated in 3 above will be collectively referred to hereinafter as "vibratory energy". In the case of a noise barrier against the sounds from speeding wheeled vehicles, for example, vibration-arresting rubber packing may be inserted to fill gaps in the assembly of the barrier structure for the purpose of enhancing the effect of intercepting the propagating sound. It has been experimentally established that this measure, if taken alone, does not prove very effective because it makes a limited contribution to the prevention of the vibratory sound generated by said three energies.

A major object of the present invention to provide a noise barrier having a larger transmission loss than a unitary noise barrier or even a noise barrier provided with a free spacing plate to form a free air layer and more specifically to provide a noise barrier which the effect of a free spacing plate is optimized by adoption of a vibration-repressing structure.

Another object of the present invention is to provide a noise barrier which is adapted to avoid generating secondary noise owing to the vibratory energy.

Still another object of the present invention is to provide a noise barrier which, on the basis of the experiment conducted on the effect of vibration from the supporting column serving to hold the noise barrier in position, is adapted so as to give the most effective attenuation of said vibration.

SUMMARY OF THE INVENTION

To accomplish the objects described according to the present invention, there is provided a noise barrier of a structure which comprises 1 a hollow cell type block composed of (a) a perforated sound-absorbing plate falling on the side confronting the noise source, (b) a sound-insulating plate disposed opposite said perforated sound-absorbing plate, (c) a plurality of partition plates disposed to separate the intervening space between said perforated sound-absorbing plate and sound-insulating plate into hollow spaces and (d) sound-absorbing material filling said hollow spaces to the extent of affording a prescribed magnitude of resistance, 2 a free-spacing plate disposed parallel to the sound-insulating plate of said block and across a space therefrom so as to interpose a free air layer between said free-spacing plate and said sound-insulating plate and 3 sound-absorbing and damping means disposed between said sound-insulating plate and said free-spacing plate. Where two or more hollow cell type blocks are piled up one on top of another, vibration-repressing joints, are used, one at each joint, to serve as means for absorbing and damping the energy of a vibrating wave.

The noise barrier according to the present invention must satisfy certain conditions in respect of the mass of the cell type block and the mass of the air confined within the block. Namely, these must be such that when a sound wave propagates toward the hollow double wall, the theoretical basic vibration wave form as obtained on the basis of the spacial distance for said wall becomes as shown in FIG. 2(I) which will be explained in detail later. Furthermore, the actual vibration wave form as shown in FIG. 2(V) must coincide with said fundamental vibration wave form in a given frequency region.

The vibration-repressing couplings to be used in the present invention are each composed of a vibration-repressing section and a connecting section. The following three types of vibration-repressing couplings may be used: A hollow structure in which the vibration-repressing section has either a rhombic or circular cross section, a porous structure in which the cross-sectional area of the vibration-repressing section is largest at the center and decreases toward both ends and a structure in which the vibration-repressing section is formed in a cylindrical form at the end adjoining the block and a leg portion is connected to the cylindrical vibration-repressing section by means of a viscous adhesive material.

The size of the noise barrier of the present invention may be selected to suit the purpose for which it is used. For example, it may be fabricated in a unitary structure of a desired size. Otherwise, a plurality of unit noise barrier blocks of a prescribed size may be set up so as to adjoin one another both horizontally and vertically.

In the case of using a plurality of unit blocks, the present invention embraces a structure wherein said unit blocks are piled up one on top of another and their lower faces and upper faces are curved mutually complementarily so as to be vertically joined stably with the medium of a suitable adhesive agent.

In the case of a plurality of unit blocks adjoined side by side, the hollow cell type blocks are arranged side by side and joined by the medium of supporting columns fitted with elastic material, with said side-by-side joining effected in such a way as to ensure repression of the vibration. Further, free-spacing plates are attached to complete a structure in which said supporting columns are wrapped in said free-spacing plates. This structure is also embraced by the present invention.

The other characteristic features and advantages of the present invention will become evident from the description to be given in further detail hereinafter with reference to the accompanying drawing.

DESCRIPTION OF THE PREFERRED EMBODIMENTS

Figure 1:
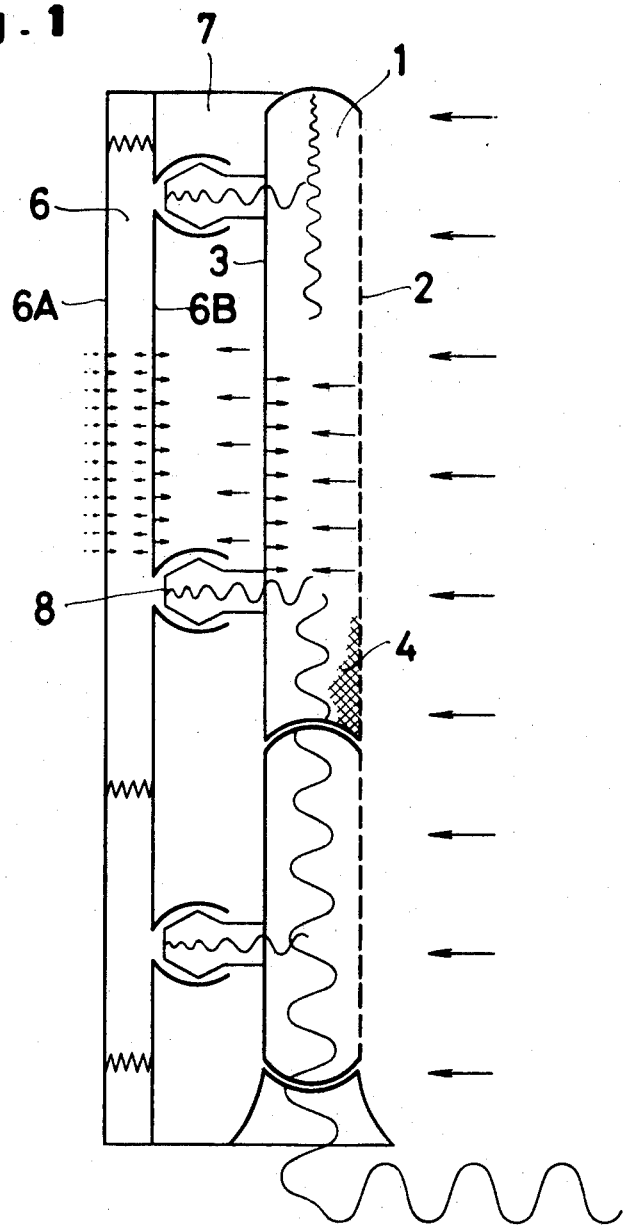
FIG. 1 is a model explanatory diagram illustrating the operating principle of the noise barrier of the present invention.

The present invention will first be described with reference to FIG. 1 as a model diagram to make clear the operation which the noise barrier of this invention performs when the acoustic waves and vibratory waves impinge thereon, although the principal vibrations from the vibratory origin are distributed preponderantly below the level of 100 Hz and defy theoretical classification. In FIG. 1, 1 denotes a hollow cell-shaped box. Said box has as its principal components a perforated sound-absorbing plate 2 and a sound-insulating plate 3, with an absorbing material 4 placed to fill the internal space. Denoted by 6 is a free spacing plate which, in the illustrated embodiment, is composed of two plates 6A and 6B. These two plates enclose therebetween an adhesive layer.

The free spacing plate and the hollow cell-shaped box are connected with each other by the medium of vibration-repressing couplings 8 serving as means for absorbing sound waves. Said box and said plate are separated from each other to form a free air layer 7 therebetween. The components which make up the present noise barrier contain no gaps and the joints formed thereon for their mutual union are also free from gaps. They are joined with one another resiliently so that the barrier in its assembled form enjoys necessary flexibility.

In the diagram, the arrow marks show the directions of the propagation of acoustic waves and the wave forms show the directions of the transmission of vibratory waves. It should be noted that although in the diagram, the propagation of acoustic waves in the lateral direction within the block is not illustrated, the propagation in the longitudinal direction and its reflection actually play an important role in the production of the effect of resonance.

The acoustic waves are partly absorbed by the sound-absorbing plate. Besides, the acoustic restriction effected within the hollow cell-shaped box and the function of the sound-absorbing material cooperate to bring about the effect of resonance. Inside said box, those of the advancing acoustic waves within a certain frequency range are reflected by the sound-insulating plate and the reflected acoustic waves interfere with the advancing acoustic waves to damp them in intensity. Then the acoustic waves pass through the free air layer 7 and the free spacing plates 6A and 6B. It is recognized that at the free spacing plate 6B, the acoustic waves are affected by the fundamental vibratory wave forms thereof and the cycle of three over tone (which is be described afterward with reference to FIG. 2). In the free spacing plate 6A, however, the acoustic waves assume a form indicated by a flat line, suggesting that the cyclicity of the acoustic waves has been destroyed and the intensity of the acoustic waves has been sharply damped. By the time that the acoustic waves have completed their passage through the entire thickness of the noise barrier, they are greatly reduced in intensity. Also the fact that the components of the noise barrier are joined resiliently with one another makes a notable contribution to the damping of the acoustic waves.

Now a description will be given as to the damping of the vibratory waves which are transmitted from the ground on which the noise barrier is erected. The vibratory waves which advance in the form of waves are illustrated find their way up the noise barrier through the base of the noise barrier. In the diagram, the noise barrier is composed of a plurality of units which have their joining ends shaped in arcuated forms and the hollow cell type block and the free spacing plate are joined with each other by the medium of vibration-repressing couplings. While the vibratory waves are travelling through these joints and couplings, they are gradually deprived of sound energy and consequently are forcibly damped. The noise barrier of the present invention, therefore, has its coefficient which is indicative of the extent of vibration damping heightened to the order of 0.5 to 0.9 as compared with the conventional noise barrier structures which usually have a coefficient of not more than 0.5.

As described above, the noise barrier of the present invention provides a sharp damping of both acoustic waves and vibratory waves in terms of energy intensity.

Figure 2:
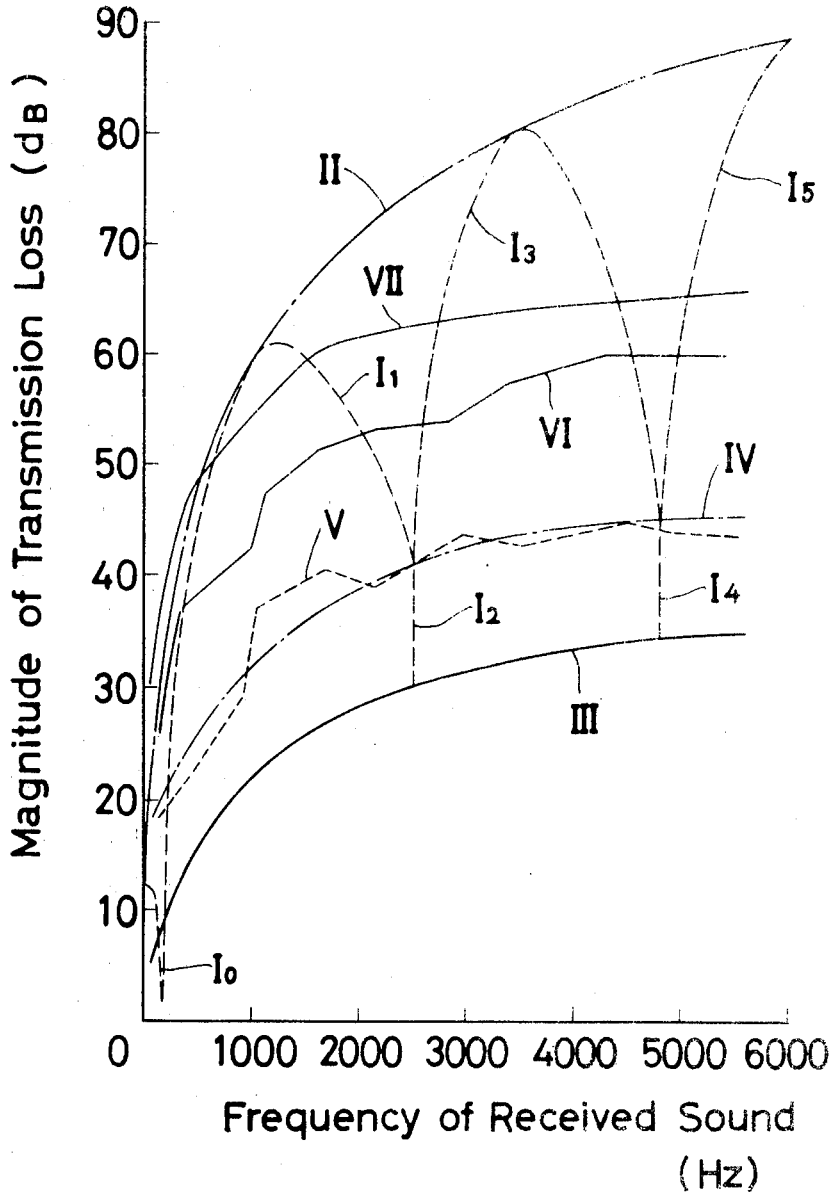
FIG. 2 is a graph which shows the theoretical values and actually found experimental values respectively of the relationship between the factors of frequency and transmission loss involved in the prevention of noise propagation, by way of illustrating the fundamental concept of the noise barrier according to the present invention.

To clarify the basic concept underlying the present invention, the relationship between the frequency of received sound (Hz) and the magnitude of transmission loss (dB) which is involved when the acoustic waves pass through a given object will be described with reference to FIG. 2. In the graph, I, $I_2$, $I_3$, $I_4$, $I_5$ and II are curves obtained of the acoustic waves passed through a double wall formed by having two aluminum plates 1 mm in thickness disposed at a distance of 70 mm from each other.

I — fundamental vibration (calculated value)
$I_3$ — three over-tone vibration (calculated value)
$I_5$ — five over-tone sound vibration (calculated value)
$I_2$ and $I_4$ — frequencies having minute transmission loss (calculated value)
II — curve drawn through maximal values (calculated value)
$I_0$ — low-frequency vibration (calculated value)

III represents the theoretical values of transmission loss which the acoustic waves impinging randomly upon a plate 2 mm in thickness experience during passage through said plate. IV represents the theoretical values of transmission loss which the acoustic waves impinging perpendicularly upon the same plate experience during passage through the plate. V represents the empirical values of transmission loss obtained in an experiment using a hollow cell type block formed by having two aluminum plates 1 mm in thickness disposed at a distance of 70 mm from each other. VI represents the empirical values of transmission loss obtained of a noise barrier of the present invention formed by disposing a steel plate 1 mm in thickness as the free-spacing plate at a distance 50 mm from the structure of V. And VII represents the empirical values of transmission loss obtained of a noise barrier of the present invention formed by adding another steel plate 1 mm in thickness to the free-spacing plate of VI in the manner of a sandwich.

While the theoretical values are as indicated by the curves I (containing $I_3$ and $I_5$), II, III and IV, the values actually found with the noise barriers are those indicated by the curves V, VI and VII. The curve VII shows the results of the noise barrier according to the present invention and it clearly indicates that the noise-arresting effect of the present invention is outstanding as described hereinafter.

The effect of the present invention will be described further with reference to the drawing.

Figure 3:
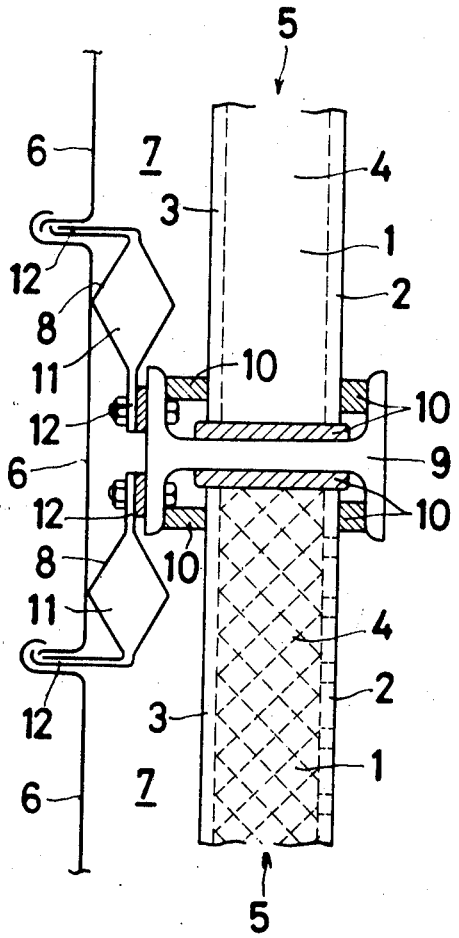
FIG. 3 is a model cross section illustrating a typical structure of the noise barrier of the present invention.

FIG. 3 is a cross section of the structure of one preferred embodiment of the noise barrier according to the present invention. In the drawing, 1 denotes a rectangular hollow cell-shaped box. Although the material of this box is not specified, it is desirable to consider manufacturing the box with aluminum, an aluminum alloy, iron or other similar material, for example. Generally, the weight of this box per unit surface area ($m^2$) is in the range of from 10 to 30 kg. The most favorable wall thickness and other factors of the box may be calculated from the frequency (Hz) of the sound waves expected to impinge upon the noise barrier. The distance between the cell plates (inner space of cell) may be determined in accordance with the basic vibration of the acoustic waves based on cell box so as to maximize the magnitude of transmission loss. The cell plate of the hollow cell-shaped box falling on the side confronting the noise source is formed of a sound-absorbing plate 2 containing perforations 8 mm in diameter at an aperture ratio of about 30 percent. The cell plate of said box disposed opposite this sound-absorbing plate is referred to as "sound-insulating plate" (denoted by 3). The hollow cell type block 5 is complete with a sound-absorbing material 4 of fibrous substance such as glass wool or rock wool which is placed to fill said hollow cell-shaped box 1. Generally, the interior of the hollow cell-shaped box is divided by partition plates (not illustrated in FIG. 3) into a plurality of hollow sections which are filled with a sound-absorbing material. By 6 is denoted a free spacing plate disposed parallel to the sound-insulating plate 3 of the hollow cell-shaped box 5 and across a space therefrom, so that a free air layer 7 is formed between the sound-insulating plate 3 and the free spacing plate 6. Denoted by 8 is means for absorbing and damping sound waves. This diagram illustrates a plurality of hollow cell-shaped blocks adjoined side by side by the medium of supporting columns 9 (H-shaped steel bars serving as the supporting columns in the illustrated embodiment). In the diagram, the items denoted by 10 are resilient members serving to hold said block 5 fast against the supporting column 8. They are inserted in a total of three types of gaps formed where the faces of the supporting column confront the nearer ends of the adjoining blocks, and the outer faces of the sound-insulating plate and those of the sound-absorbing plate. These resilient members 10 serve the dual purpose of holding said blocks in position and absorbing the propagating vibratory waves on their way to the blocks. A typical structure of the sound wave-absorbing means for use in the present invention consists of a vibration-repressing section 11 and a connecting section 12 adapted to permit connection of the present means. In the particular embodiment illustrated in FIG. 3, said sound wave-absorbing means consists of a vibration-repressing section having an equilateral (rhombic, to be specific) cross section and a connecting section which are composed of legs disposed on opposite sides of said absorption-repression section. In the diagram, one leg is fastened with bolts to the supporting column and the other leg is bent perpendicularly in the direction of the noise source. The bend portion of the leg overlaps with the end portion of the free spacing plate 6 to wrap it in for firm union. The hollow vibration-repressing section of a rhombic cross section illustrated in this diagram is desired to be made of a metal plate possessed of resiliency, such as a plate of iron or aluminum, for example. The thickness of the metal plate is in the range of from 0.5 to 2.0 mm. The inner angles of said rhombic cross section are required to fall in the range of from 60° to 120° C, so that the incident vibratory energy will be deflected to advance in two directions to break up and damp the vibratory waves. This means that the acoustic waves which have passed through the hollow cell-type block and enter the free air layer, are damped because of counterflow interference and consequent attenuation of resonance and, at the same time, are further more subjected to the action of the waves synthesized by virtue of the sound-absorbing means. The magnitude of transmission loss is consequently heightened. Take, for example, a noise barrier wherein the sound-absorbing plate and the sound-insulating plate are separated by a distance of 70 mm, the free spacing plate is made of an iron plate 1.0 mm in thickness, the free air layer has a thickness of 50 mm and the rhombic cross section measures 40 mm × 25 mm and contains an inner angle of 60°. In this case, the magnitude of transmission loss can be improved by about 10 dB in the frequency range of from 500 to 6,000 Hz. The fact that the ends of said box are tightly sealed with the resilient members 10, thereby, precluding otherwise possible leakage of acoustic energy also contributes to heightening the sound arresting property.

Figure 4:
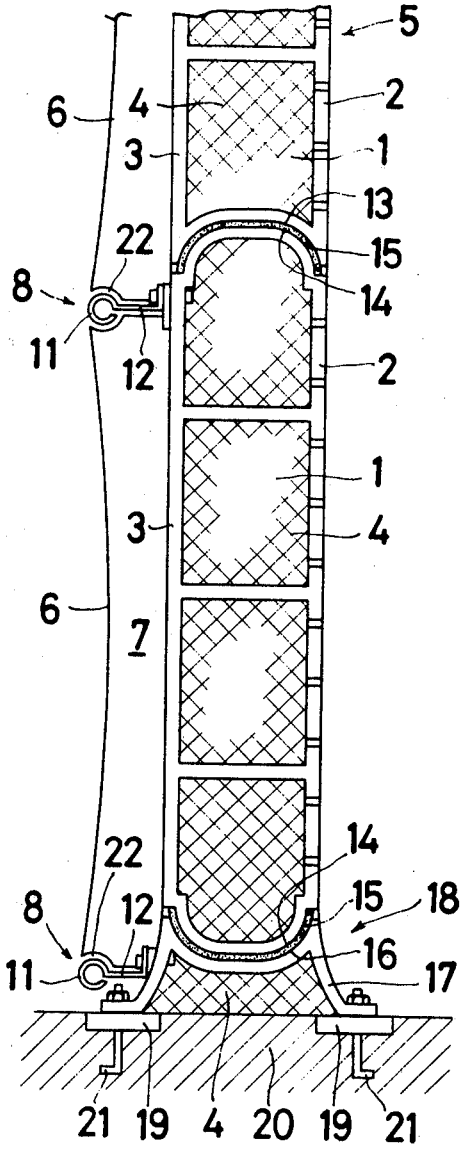
FIG. 4 is a longitudinal cross section of a typical structure having a plurality of hollow cell type blocks piled up one on top of another according to the present invention.

FIG. 4 is a longitudinal cross section illustrating the structure of one preferred embodiment having a plurality of hollow cell type blocks piled up one on top of another. In the diagram, 5 denotes the individual hollow cell type blocks. The upper and lower faces 13, 14 of these blocks are complementarily curved in arcuate shapes and, therefore, contain indentation and corresponding protuberances. They are set and joined in position by the medium of adhesive layers 15. In this case, the lowermost block is set and joined in position by the medium of an adhesive layer 15 with a hollow base 18 the shell of which is formed with a curved top 16 and legs 17. These legs extend apart from each other and their forward ends are mounted on the foundation 20 by the medium of shock absorbing members 19 (such as of vibration-absorbing rubber) and are fastened with the aid of anchor bolts 21. The cavity inside the base 18 is filled with a sound-absorbing material 4 (such as of glass wool).

Figure 5:
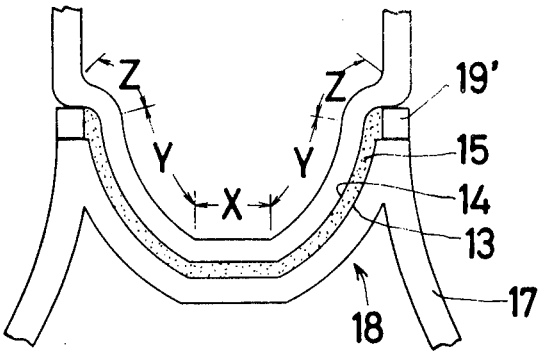
FIG. 5 is a diagram illustrating in full detail the manner in which the lowermost one of the plurality of hollow cell type blocks piled up one on top of another as shown in FIG. 3 is joined to a hollow base.

FIG. 5 is an enlarged view of the hollow base 18 and the lowermost block as used in the assembly of FIG. 4. The effect of vibration-repression obtained by the present invention will be described with reference to this diagram. The inwardly curved face 13 between the legs 17 of said hollow base 18 and the outwardly curved face 14 of the lowermost hollow cell type block are joined fast by the medium of the adhesive layer 15 which is confined at its outer edges by packings 19'. In this case, in the cross section of the curved face 14, the portion indicated by "X" is horizontally straight, the portions "Y" extending from the opposed ends of said straight portion "X" each form a parabolic curve and said parabolic portions "Y" each continue into a curved section indicated by "Z". The cross section of the inwardly curved face 13 is complementary with respect to that of said curved face 14. When the faces intended to adjoin each other have a mutually complementary structure as described above, the joint formed therebetween provides uniform and powerful damping of the vibratory energy in accordance with the particular vibratory wave form involved.

In FIG. 4, 6 denotes a free spacing plate which is so disposed as to enclose a free air layer 7 in conjunction with the sound-insulating plate 3 and which is connected with the sound-insulating plate 3 by the medium of a vibration-repressing coupling 8. The coupling illustrated in the present diagram comprises a hollow cylindrical vibration-repressing section 11 and legs 12, which are connected with said hollow cylindrical section and fastened to the sound-insulating plate 3 by means of bolts. The portion of the free spacing plate 6 which comes into contact with the vibration-repressing coupling is formed in a shape complementary with the outer contour of said coupling. By the medium of the adhesive layer 22, said plate and said coupling are set and joined in position.

In the noise barrier illustrated in this diagram, the joined portions of all the components making up the noise barrier are closely sealed so that the joints formed thereby do not allow leakage of acoustic energy propagated in the air. The contacting faces between the adjoining boxes and those between the lowermost box and the base are curved. Thus the vibratory energy which reaches this noise barrier is damped and the vibratory waves are consequently thrown out of phase with each other, with the result that the generation of secondary noise due to vibrations will be prevented. In this diagram, the free spacing plate 6 has a curved face. A curved plate excels the flat plate in sound-arresting characteristics for the following reasons. The acoustic waves which impinge upon the curved plate are reflected by the curved face and are repeatedly subjected to diffusion, interference and damping, giving rise to the phenomenon of counterflow damping and attenuation of resonance. The effect brought about by the curved face, convexed or concaved, is the same insofar as the relative positioning is proper. The various conditions such as the curvature of the curved face of the free spacing plate and the structure for attachment of the vibration-repressing coupling to said plate as well as the distance between the adjoining couplings, the material and wall thickness of the free spacing plate, the dimensions of the free air layer, etc. which are most favorable for the present invention are determined by taking into due consideration the nature of noise source and the purpose for which the noise barrier is used.

In the aforementioned free spacing plate having a curved face, if this plate is joined with the vibration-repressing coupling by adhesion of the kind shown in FIG. 3, the union is obtained with increased strength because of the powerful resilience of the curved plate. The noise barrier, therefore, enjoys increased power to resist external forces such as wind pressure.

The free air layer has its sound arresting effect enhanced when it is filled with a sound-absorbing material such as of glass wool or rock wool. This is because the material functions to damp, rectify and filter the acoustic waves (namely, produces the action to filter, flatten and converge the sound waves of varying frequencies reaching the material from all directions). The desirability of the incorporation of such sound-absorbing material in the free air layer is not limited to this particular embodiment but is true with the noise barriers embraced by this invention. It is particularly effective in controlling sounds of low-frequency zones.

Now, the vibration-repressing couplings to be used as means for absorbing sound waves will be described in full detail.

The function of the vibration-repressing coupling used in the present invention has already been described with reference to FIG. 3 and FIG. 4. Here, the operation of said coupling will be described more generally. The coupling serves the purpose of connecting the free spacing plate with the hollow cell type block and simultaneously damping the sound waves and the vibrations being propagated to the noise barrier. To fulfil the function, the coupling is required to have a shape capable of providing necessary connection and, at the same time, to have a structure capable of producing phase shifts in vibratory waves and varying the directions of said waves through voluminal change ($\Delta V$).

To satisfy the requirements described above, the vibration-repressing couplings for use in the present invention are classified into three types as shown below:

1. The type wherein the vibration-repressing section has a hollow structure and has an equilateral cross section as illustrated in FIG. 3.
2. The type wherein the vibration-repressing section has a hollow structure and it is connected with the noise-insulating plate by the medium of legs disposed continuously onto said hollow section as illustrated in FIG. 4.
3. The type wherein the cross-sectional area of the vibration-repressing section is largest at the center and gradually decreases towards both ends.

Figure 6:
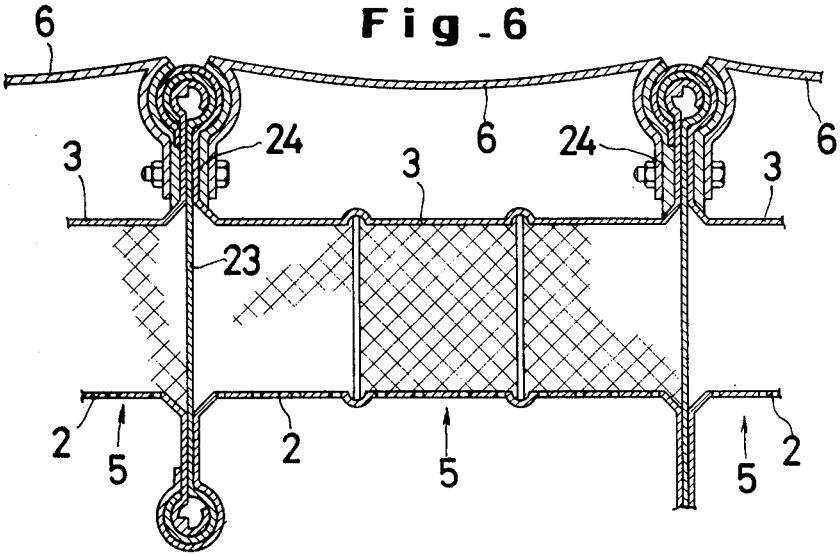
FIGS. 6–9 and FIG. 11 are diagrams of various noise barrier structures of the present invention, drawn to illustrate preferred embodiments of the vibration-repressing couplings usable therein.
Figure 7:
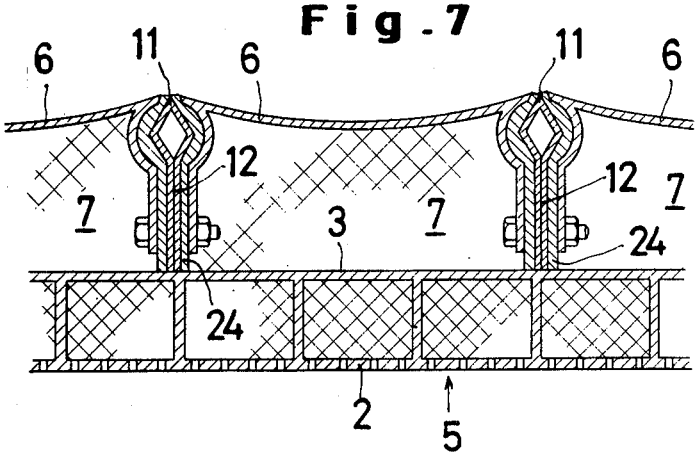

The vibration-repressing couplings used in the noise barriers illustrated in the longitudinal cross sections of FIG. 6 — FIG. 7 belong under the type 2 above, although they represent rather modified versions.

FIG. 6 illustrates a plurality of hollow cell type blocks 5 adjoined side by side. In this assembly, one partition plate 23 whose opposite ends are bent each in the form of a hook in cross section is interposed between one block and the adjoining block. To permit the union of these two blocks, the opposite ends of the sound-insulating plate 2 and those of the sound-absorbing plate 3 are extended out of the block proper and similarly bent. By inserting the bent ends of these plates into the bent ends of an intervening partition plate 23 and fastening them as illustrated, the two blocks and the intervening partition plate are united integrally. In this case, the leading end of the partition plate 23 falling on the sound-absorbing plate side has the form of a hollow tube. Since, in this case, the sound-absorbing plate 3 and the free spacing plate 6 are connected with each other for the safety by means of bolts as illustrated, said hollow cylinder formed at the end serves as a vibration-repressing coupling. By 24 is denoted an adhesive layer which adds to the effect of the union formed thereon.

FIG. 7 illustrates a similar assembly wherein the vibration-repressing section 11 is in the shape of a tube of rhombic cross section. The free spacing plate 6, the rhombic tube 11, the legs 12 fastened to said tube and the sound-insulating plate 3 are joined to one another by means of an adhesive layer 24 and a bolt. In the sound-absorbing plate 2, circular perforations 8 mm in diameter are bored at a prescribed aperture ratio (of 30%, for example).

Figure 9:
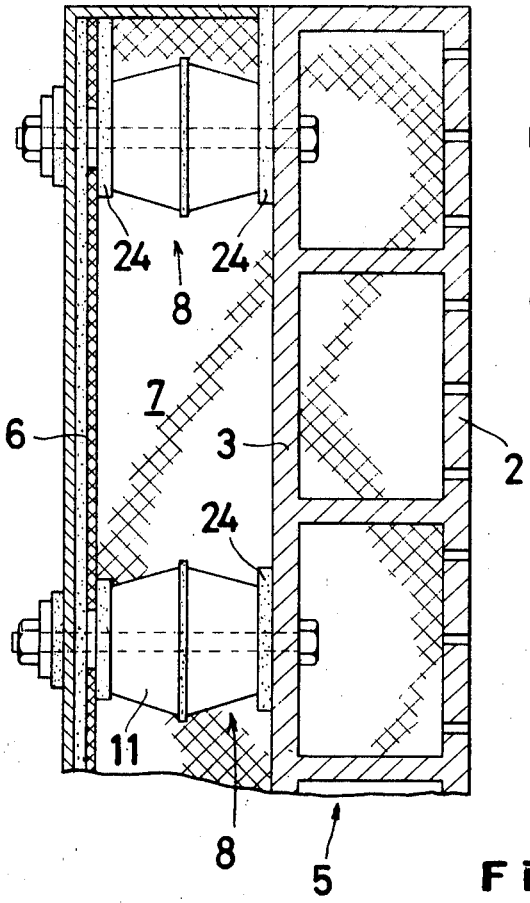
Figure 8:
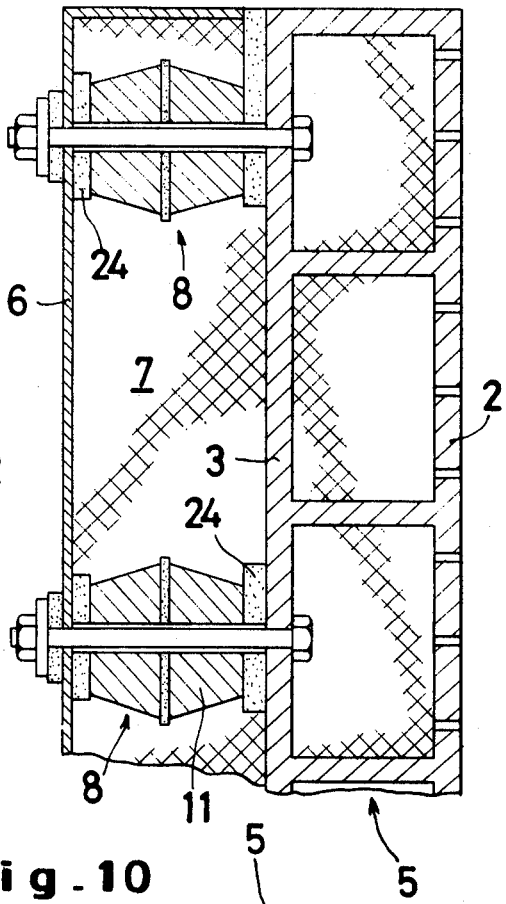

FIGS. 8–9 are to illustrate the aforementioned vibration-repressing couples of the type 3). The hollow cell type block 5 is joined with the free spacing plate 6 in such a way that they enclose the free air layer 7 therebetween. The ends of the free spacing plate are bent and connected with said block so as to seal the cavity formed to serve as the free air layer 7. By 8 is denoted the vibration-repressing coupling which contains a vibration-repressing section 11. Said section 11 is made of a porous substance in a structure in which the cross section is largest at the center and gradually decreases towards both ends. To put the inherent acoustic resistance to the best advantage, said porous substance should be of a type diffusely pervious to air and possessed of a specific gravity in the range of from 0.2 to 1.5. For example, cork and light-weight foamed concrete are used advantageously. Further, those composites which are formed by shaping such artificial mineral fibers as glass wool, rock wool and perlite fibers with water glass, cement and other inorganic binders or with organic binders are also usable. It is an essential requirement that said porous section 11 have a structure such that the cross section is largest at the center. The shape of said cross section may be rhombic, circular, octagonal or otherwise; it may assume any reasonable shape insofar as it gives voluminal change to the vibrations being propagated, causes phase differences and forced attenuation of vibratory waves and breaks up and damps the vibrations. This porous section is disposed between the noise-insulating plate 3 and the free spacing plate 6. It may be attached to said plates directly or by the medium of an adhesive layer (which may incorporate a rubbery element). The section serves the purpose of enhancing the effect of vibration damping by causing energy loss through the phenomenon of strain. The embodiments illustrated in FIGS. 8–9 are provided with such adhesive layer 24. For practical purpose, the thickness of the adhesive layer ranges from 0.2 to 2.0 mm.

In the illustrated embodiments, the porous section is fastened in position by means of bolts. In this case, the absorption of vibrations by said section may be accomplished more effectively by boring the holes for insertion of said bolts to a larger diameter than that of the shanks of the bolts so that the porous section may be joined with a certain degree of looseness.

The porous section may be formed by joining a plurality of unit segments by the medium of adhesive layers. When such a porous section is used, the effect of vibration damping is enhanced because of the effect of deflection produced by said adhesive layers. The effect of vibration damping is further improved when the porous section is made up of unit segments differing in quality from one another so that it will offer different degrees of acoustic resistance.

In the embodiment of FIG. 8, the free spacing plate is formed of a single piece. It may be made of a metallic substance such as aluminum or iron or a non-metallic substance such as asbestos slate, gypsum board or synthetic resin sheet.

The free spacing plate 6 in the embodiment of FIG. 9 is a composite piece which may be made of any combination of metallic substances and or nonmetallic substances. For example, it may be fabricated by preparing a plate of iron, aluminum or lead 0.3 to 2.0 mm in thickness and overlaying this plate with asbestos slate, gypsum board or synthetic resin sheet with the medium of an adhesive agent. In this case, it is desirable that the plate and its lining be separated by a gap of not less than 0.2 mm, preferably from 0.2 to 2.0 mm, lest they should come into direct contact with each other. The adhesive agent interposed therebetween serves the purpose of diminishing the vibratory energy and absorbing the acoustic energy because of the effect of deflection.

In the noise barrier of the present invention the couterflow damping and attenuation resonance is caused in the free air layer. Thus, the magnitude of transmission loss can be increased by using a composite free spacing plate over that attained with the noise barrier using a single free spacing plate, as is evident from the graph of FIG. 2. The component substances used in the composite free spacing plate may be a combination of two metals, a combination of a non-metallic substance and a metallic substance, or a combination of nonmetals, whichever may be convenient to the occasion. The magnitude of transmission loss is greater when the component plates have different values of acoustic resistance than otherwise.

Figure 10:
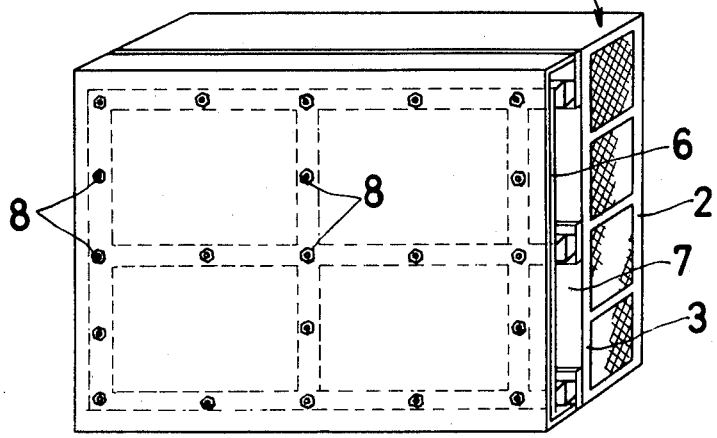
FIG. 10 is an outward view of the structure of one preferred embodiment of the noise barrier in a state assembled for practical use according to the present invention.

FIG. 10 illustrates the outward appearance of the structure of one practical embodiment of the noise barrier shown in FIG. 8 or FIG. 9.

The hollow cell type block 5 is provided with the free spacing plate 6 in such a way that they will enclose a free air layer therebetween. By 8 is denoted the vibration-repressing coupling which serves to connect the free spacing plate with the sound-insulating plate on the block. The noise barrier enjoys an extremely high magnitude of transmission loss when the vibration-repressing coupling is so fabricated as to incorporate cavities as illustrated.

Figure 11:
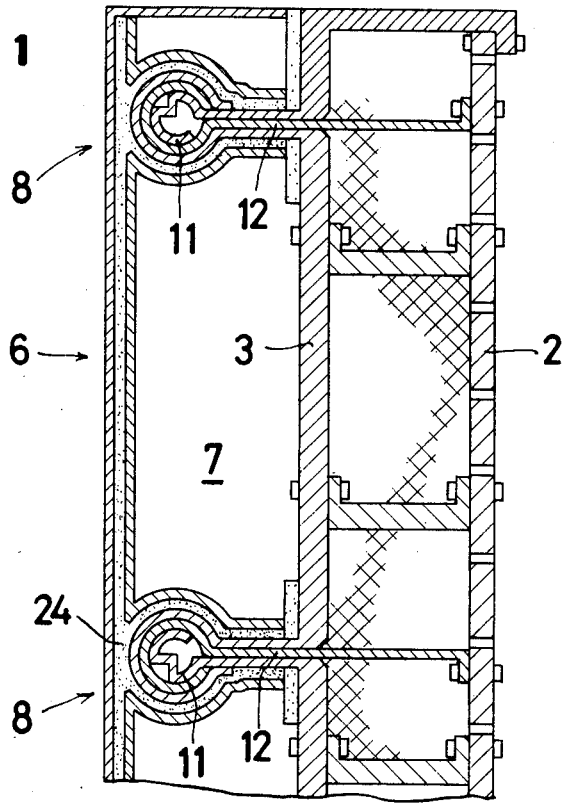

FIG. 11 also illustrates a modification of the noise barrier, in the sense that it incorporates the vibration-repressing coupling of the type 2 mentioned previously. In FIG. 11, 8 denotes the vibration-repressing coupling wherein the vibration-repressing section 11 is in the shape of a tube and the connecting section is connected with the sound-insulating plate 3 and the sound-absorbing section 2. Between the free spacing plate 6 and the sound-insulating plate 3 there is formed a free air layer 7. In this illustrated embodiment, the free spacing plate is made of a composite plate containing an intervening adhesive layer 24. In the embodiment of FIG. 11, the vibration-repressing coupling is attached inside one hollow cell-shaped box. In the case of the embodiment of FIG. 11, however, the vibration-repressing couplings are disposed between the sound-absorbing plate 2 and the free spacing plate 6. The gap between the component plates of the free spacing plate and that between the vibration-repressing coupling 8 and the free spacing plate are filled with adhesive agent each to form an adhesive layer 24.

In the preferred embodiment illustrated in FIG. 11, both vibration repressing and transmission loss effected by the vibration-repressing coupling and the adhesive layer are extremely high.

Figure 12:
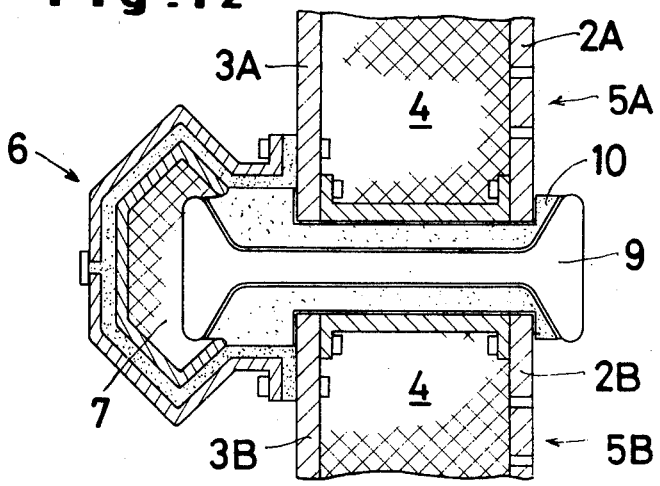
FIG. 12 is a diagram illustrating a noise barrier structure of the present invention, wherein the free spacing plate incorporated provides covering for the supporting column.

The noise barrier illustrated in FIG. 12 fundamentally based on the same operating principle as the preferred embodiment of FIG. 11. The present noise barrier characteristically uses a plurality of hollow cell type blocks adjoined side by side by the medium of supporting columns and aims to preclude otherwise possible leakage of vibrations and sound waves from said supporting columns. In the diagram, two hollow cell type blocks 5A and 5B are erected in position by the medium of a supporting column 9. The blocks 5A and 5B are perfectly identical with the block of the aforementioned type and they incorporate the sound-absorbing plates 2A and 2B and the sound-insulating plates 3A and 3B respectively. The spaces interposed between the opposite plates are divided by partition plates into a plurality of cavities, which are filled with a sound-absorbing material 4. By 6 is denoted the free spacing plate the opposite ends of which are fastened to the sound-insulating plates 3A and 3B and adapted to cover the lateral faces of the supporting column 9 falling on the sound-insulating plate side. Said opposite ends and the lateral faces of the supporting column embrace spaces one on either side to form a free air layer 7.

The effect of this noise barrier is enhanced by filling these free air layers with sound-absorbing material. Denoted by 10 is a resilient member which is placed to fill the groove in the supporting column 9. It serves the purpose of setting the hollow cell type block in position and, at the same time, enhancing the sound-insulating effect and the vibration-repressing effect. Practically, the structure can be obtained more readily because the free spacing plate can be extended from the block side enough to provide necessary covering.

The principle of the operation of this invention and various embodiments of the noise barrier based on this principle have been described in detail. The noise barrier according to the present invention enjoys extremely high noise transmission loss as compared with any of the conventional noise barriers. It can be fabricated without difficulty. And the noise barrier of desired performance and desired dimensions can freely be manufactured to suit best the particular kind of noise source.

Figure 13:
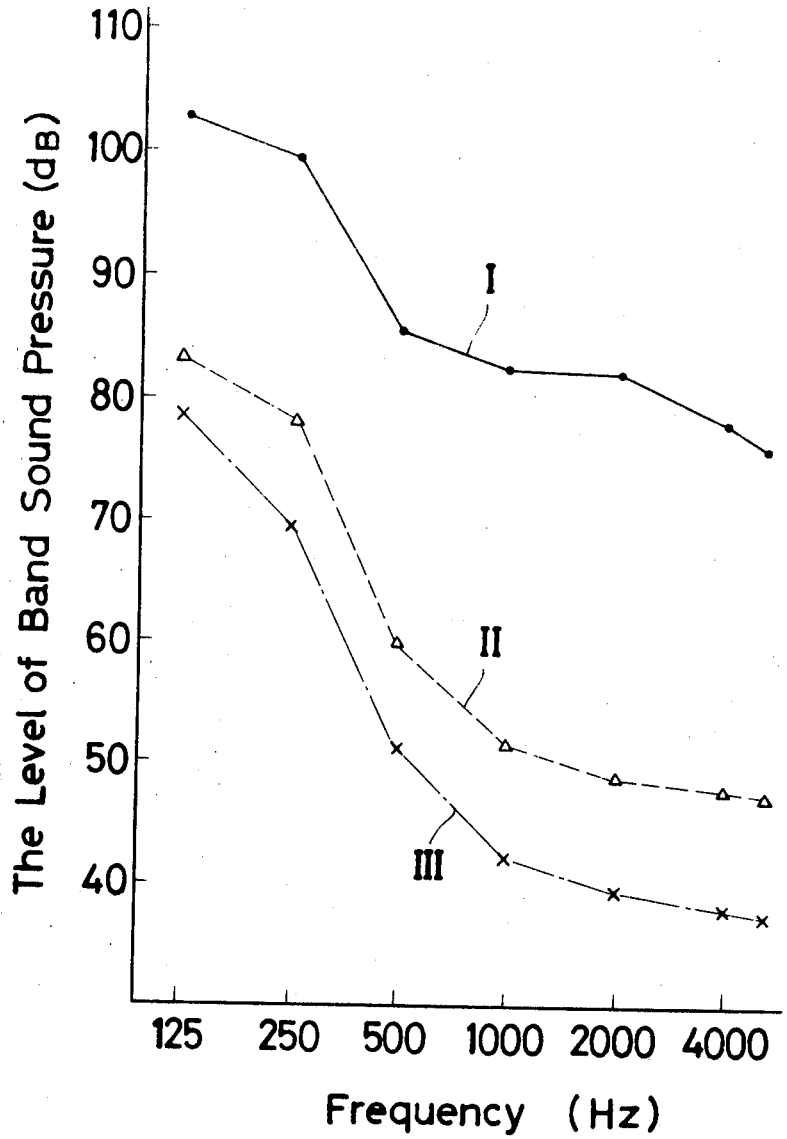
FIG. 13 is a graph showing the results of an experiment conducted for the investigation of the noise insulating effect of the present invention, with an internal-combustion engine used as the noise source.

FIG. 13 is a graph which shows the results of an experiment conducted to demonstrate the effect of the noise barrier of this invention employed to control the noise from an internal-combustion engine which emitted noise in conjunction with vibration.

In this graph, the vertical axis is graduated for the level of band sound pressure (dB) and the horizontal axis graduated for the frequency (Hz).

In the graph,

Curve I represents the data obtained at a distance of 30 cm from the engine, without using any noise barrier.

Curve II represents the data obtained on the outside of a noise barrier of the following description erected around the engine at a distance of 50 cm.
Area of hollow cell type block — 2 m × 2 m
Thickness of component plates of block — 2 mm
Inside thickness of block — 70 mm Aperture rates of perforated sound-absorbing plate — About 30%
Diameter of perforation — 8 mm
Diameter of fiber of glass wool used as sound-absorbing material — 9 μ
Density of sound-absorbing material — 36 kg/m³

Curve III represents the data obtained at a distance of 30 cm from the free spacing plate on the outside of a noise barrier of the following description erected around the engine at a distance of 50 cm: The noise barrier was composed of the same hollow cell type block as in II above, except it had a free spacing plate attached thereto by the medium of a coupling. Said free spacing plate was formed of a curved plate of aluminum 2 mm in wall thickness and 18 mm in depth of curved face. The vibration-repressing coupling was of a shape like the one illustrated in FIG. 4. In this coupling, the tube section measured 25 mm in outside diameter and 1 mm in wall thickness and the legs were 25 mm long. The couplings were disposed at intervals of 1 m.

At the point of measurement, a sound pressure level of 1 m was detected.

Comparison of the data of Curve III with those of the other two curves clearly indicates that the effect of the noise barrier of this invention is outstanding.

What is claimed is:

1. A noise barrier comprising (1) a hollow cell type block composed of (a) a perforated sound-absorbing plate falling on the side confronting the noise source, (b) a sound-insulating plate disposed opposite said perforated sound-absorbing plate, (c) partition plates disposed between said two plates so as to divide the intervening space between said two plates into a plurality of cavities and (d) a sound-absorbing material placed to fill said cavities, (2) a free spacing plate disposed parallel to said sound-insulating plate and across a space therefrom so as to enclose a free air layer in conjunction with said sound-insulating plate and (3) vibration-repressing means coupling said hollow cell type block and said free spacing plate.

2. The noise barrier according to claim 1, wherein the free air layer is filled with sound-absorbing material.

3. The noise barrier according to claim 1, wherein the free spacing plate is formed of a curved plate.

4. The noise barrier according to claim 1, wherein the free spacing plate is formed of a unitary metal plate.

5. The noise barrier according to claim 1, wherein the free spacing plate is formed of a plurality of plates joined in the form of a sandwich panel by use of an adhesive agent.

6. The noise barrier according to claim 5, wherein the component plates are each selected from the group consisting of metallic and non-metallic substances.

7. The noise barrier according to claim 1, wherein said vibration-repressing coupling comprises a vibration-repressing section and a connecting section.

8. The noise barrier according to claim 7, wherein the vibration-repressing section of the vibration-repressing coupling has a hollow structure of an equilateral cross section.

9. The noise barrier according to claim 8, wherein the equilateral cross section is rhombic.

10. The noise barrier according to claim 7, wherein the vibration-repressing section of the vibration-repressing coupling has a porous structure the cross section of which is largest at the center and gradually decreases towards both ends.

11. The noise barrier according to claim 7, wherein the vibration-repressing section of the vibration-repressing coupling has the shape of a tube and it is connected with the noise-insulating plate by the medium of legs disposed continuously onto said tube.

12. The noise barrier according to claim 11, wherein the tube is cylindrical.

13. The noise barrier according to claim 1, wherein a plurality of hollow cell type blocks are piled up one on top of another, the upper and lower faces of the component blocks are complementarily curved and the curved upper and lower faces are joined by the medium of an adhesive agent.

* * * * *